US011407233B2

(12) United States Patent
Liao et al.

(10) Patent No.: US 11,407,233 B2
(45) Date of Patent: Aug. 9, 2022

(54) HEAT TRANSFER PRINTING ON-LINE CODE PRINTING SYSTEM

(71) Applicant: Sichuan Petrochemical Yashi Paper Co., Ltd., Chengdu (CN)

(72) Inventors: Zhiyong Liao, Chengdu (CN); Bing Xu, Chengdu (CN); Shijun Wu, Chengdu (CN); Qiang Xu, Chengdu (CN); Zhiqiang Li, Chengdu (CN); Jinguo Yang, Chengdu (CN)

(73) Assignee: SICHUAN PETROCHEMICAL YASHI PAPER CO., LTD., Chengdu (CN)

( * ) Notice: Subject to any disclaimer, the term of this patent is extended or adjusted under 35 U.S.C. 154(b) by 0 days.

(21) Appl. No.: 17/245,072

(22) Filed: Apr. 30, 2021

(65) Prior Publication Data

US 2022/0016901 A1 Jan. 20, 2022

(30) Foreign Application Priority Data

Jul. 14, 2020 (CN) ..... 202010671868.X

(51) Int. Cl.
*B41J 2/32* (2006.01)

(52) U.S. Cl.
CPC ..... *B41J 2/32* (2013.01)

(58) Field of Classification Search
CPC ... B41J 2/325; B41J 2/3353; B41J 2/32; B41J 2/525; B41J 35/16; B41J 35/18; B41J 2002/0052; B41M 5/345; B41M 5/44; B41F 16/00; B41F 16/0006
See application file for complete search history.

(56) References Cited

U.S. PATENT DOCUMENTS

2003/0007060 A1* 1/2003 Nakamura ..... B41J 2/355 347/213
2009/0046136 A1* 2/2009 Choi ..... B41J 17/32 347/214
2010/0039488 A1* 2/2010 Silverbrook ..... B41J 15/044 347/102

* cited by examiner

*Primary Examiner* — Kristal Feggins
(74) *Attorney, Agent, or Firm* — FisherBroyles, LLP

(57) ABSTRACT

The present disclosure discloses a heat transfer printing on-line code printing system. A conveyor belt is arranged on a worktable. A pressing conveyor and a code printer are erected on the worktable. The pressing conveyor includes a mounting frame. An adjustment frame located above the conveyor belt is arranged on the mounting frame. Two roller groups that are arranged opposite to each other are rotatably arranged on the inner side of the adjustment frame. Acting sides of the two roller groups penetrate out from the bottom of the adjustment frame to the position above of the conveyor belt. The two roller groups are in coaxial transmission. The adjustment frame is connected to the mounting frame, and the mounting frame is in threaded connection with an adjustment rod. The inner side of the mounting frame is connected with multiple support components that are elastically pressed against the adjustment frame.

20 Claims, 5 Drawing Sheets

HEAT TRANSFER PRINTING ON-LINE CODE PRINTING SYSTEM

CROSS-REFERENCE TO RELATED APPLICATIONS

This application claims the priority and the benefit of Chinese Application No. 202010671868.X, filed Jul. 14, 2020, the entire disclosure of which is hereby incorporated herein by reference.

TECHNICAL FIELD

The present disclosure relates to the technical field of coding equipment, and in particular, to a heat transfer printing on-line code printing system.

BACKGROUND

Heat transfer printing code printer is a code printer. Compared with an ordinary ink wheel code printer, there is no fixed character grain, and the code printer is provided with an integrated block (print head). The application scope of the heat transfer printing code printer is that: it can be used for performing on-line printing on a package label made of a soft and thin material and a smooth card surface, or for the (any) occasion where a bar code needs to be printed, and for the occasion where real-time information needs to be printed, which can be accurate to the production time.

The existing heat transfer printing code printer and a conveyor belt are matched to form a heat transfer printing on-line code printing system. In order to make the heat transfer printing code printer be able to perform code printing and marking work on a label tape or a card tape continuously and stably, a pressing conveyor located above the conveyor belt is also arranged at the front end of the heat transfer printing code printer. The label tape or card tape is pressed and conveyed to the direction of the heat transfer printing code printer through the pressing conveyor.

Now, power devices are arranged for driving both the conveyor belt and the pressing conveyor, and the distance between the pressing conveyor and the conveyor belt is adjustable. When the distance between the pressing conveyor and the conveyor belt is adjusted, first, the operating states of the pressing conveyor and the conveyor belt are stopped, and then the distance between the pressing conveyor and the conveyor belt is adjusted. After the distance is adjusted, the operating states of the pressing conveyor and the conveyor belt are restarted again, so that the operating speeds of the pressing conveyor and the conveyor belt need to be readjusted. The conveyor belt and the pressing conveyor are driven to operate by different power devices, so the conveying speeds of the conveyor belt and the pressing conveyor to the label tape or card tape are easily inconsistent, which easily leads to the problem that the label tape or card tape is stuck to affect normal work in a conveying process.

SUMMARY

In view of the disadvantages in the prior art, the objective of the present disclosure is to provide a heat transfer printing on-line code printing system, so as to solve the problems, in the prior art, that conveying speeds of a conveyor belt and a pressing conveyor to a label tape or card tape are easily inconsistent because the conveyor belt and the pressing conveyor are driven to operate by different power devices, which easily leads to the problem that the label tape or card tape is stuck to affect normal work in a conveying process.

In order to achieve the objective above, the present disclosure adopts the following technical solutions: a heat transfer printing on-line code printing system, including a worktable. A conveyor belt which is driven by a power device fixedly arranged on the worktable is arranged at the top of the worktable in the length direction thereof. A pressing conveyor and a code printer are sequentially erected on the worktable along a conveying line of the conveyor belt. The pressing conveyor includes a mounting frame which is connected to the worktable and is erected on the two sides of the conveying line of the conveyor belt. An adjustment frame located above the conveyor belt is arranged on the inner side of the mounting frame. Two roller groups that are arranged opposite to each other are rotatably arranged on the inner side of the adjustment frame. The two roller groups are distributed above the edges of two sides of the conveying line of the conveyor belt. Both acting sides of the two roller groups penetrate out from the bottom of the adjustment frame to the position above the conveyor belt. The two roller groups are in coaxial transmission. One of the roller groups is in transmission with a power device through a first belt.

The adjustment frame is connected to the mounting frame through a guide structure, and the mounting frame is in threaded connection with an adjustment rod that is pressed against the top of the adjustment frame. The inner side of the mounting frame is connected to multiple support components that are elastically pressed against the bottom of the adjustment frame. The multiple support components are all located above the acting sides of the two roller groups.

When the adjustment frame is moved by rotating the adjustment rod, the adjustment frame is moved, through the guide structure, in the direction of an arc which takes the power device as a center and the length of the first belt as a radius.

Compared with the prior art, the present disclosure has the following beneficial effects:

In the heat transfer printing on-line code printing system, the conveyor belt is driven to operate by the power device, and meanwhile, the power device makes one roller group connected thereto operate through the first belt. The two roller groups are in coaxial transmission, so that the two roller groups operate synchronously to press and convey the label tape or card tape on the conveyor belt. The contact between the two roller groups and the label tape or card tape on the conveyor belt is ensured by matching the position designs of the acting sides of the two roller groups, so as to perform press and convey. In addition, the adjustment frame cannot be in contact with the label tape or card tape on the conveyor belt to limit the conveying. The adjustment frame is supported and fixed by multiple support components. When the distance between the conveyor belt and the adjustment frame needs to be adjusted, the adjustment frame is moved by rotating the adjustment rod, and the moving direction of the adjustment frame is limited through the guide structure, so that the first belt is kept in a tension state all the time, thereby driving the conveyor belt and the two roller groups synchronously by the power device all the time. Then, the conveying speeds of the conveyor belt and the two roller groups to the label tape or card tape on the conveyor belt are the same all the time, so that the label tape or card tape on the conveyor belt can be fed to the code printer safely and stably.

DETAILED DESCRIPTION

The present disclosure will be further described in detail below with reference to specific implementation manners:

numerals in accompanying drawings of the description include: 1—worktable; 2—power device; 3—conveyor belt; 4—adjustment frame; 5—first belt; 6—adjustment rod; 41—top plate; 42—vertical plate; 7—gap; 8—roller; 9—second belt; 10—transmission shaft; 11—stabilizing plate; 12—jacking spring; 13—jacking block; 14—mounting frame; 15—arc-shaped guide hole; 16—arc-shaped guide groove; 17—gantry; 18—code printer body; 19—chute; 20—mounting cavity; 21—supporting block; 22—sliding block; 23—first bevel gear; 24—transmission rod; 25—drive rod; 26—circular gear; 27—second bevel gear; 28—gear rack; 29—elastic telescopic rod; 30—traction rod; 31—limiting block; 32—support sleeve spring.

Figure 1:
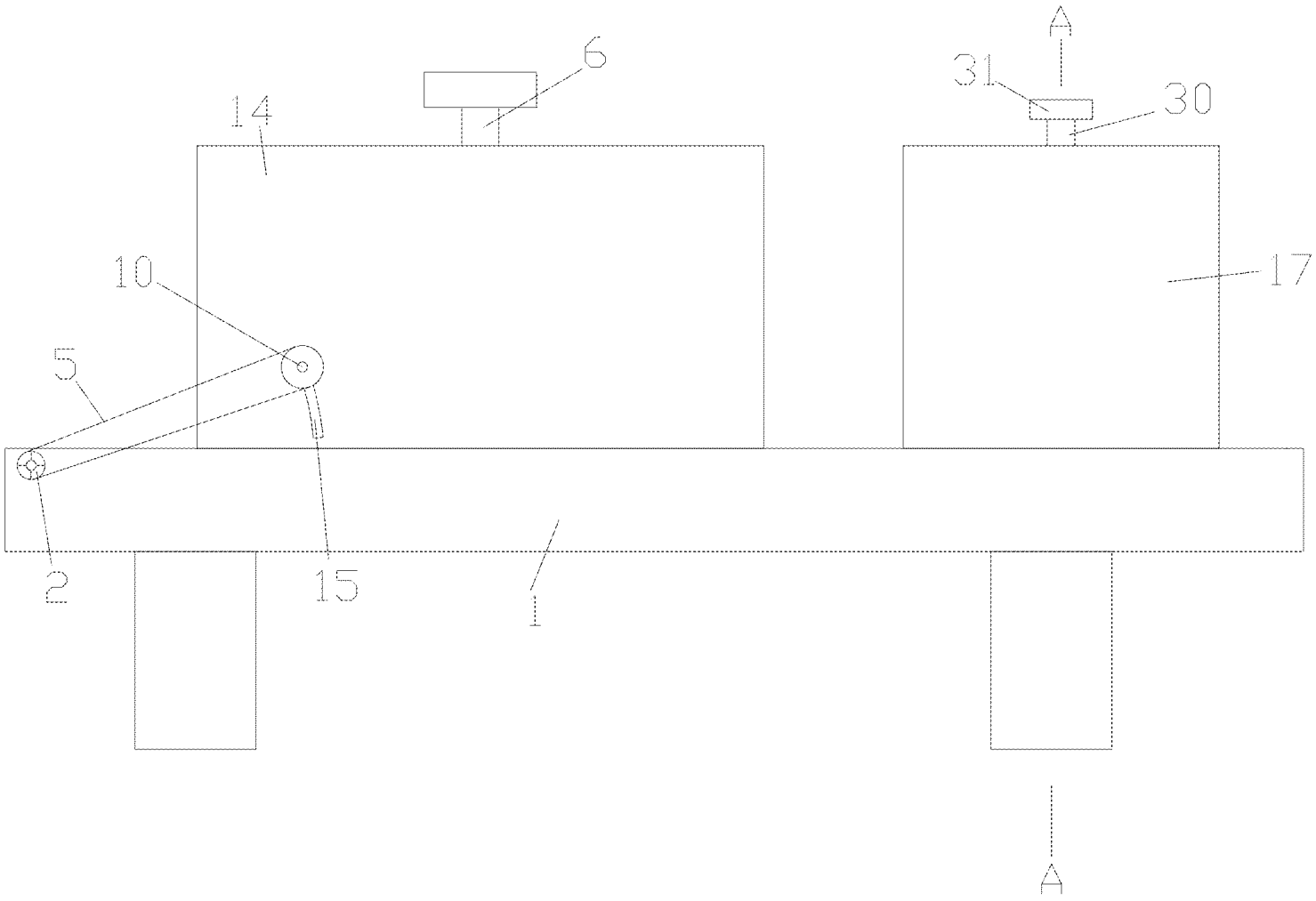
FIG. 1 is a structural schematic diagram of an embodiment of the present disclosure.
Figure 2:
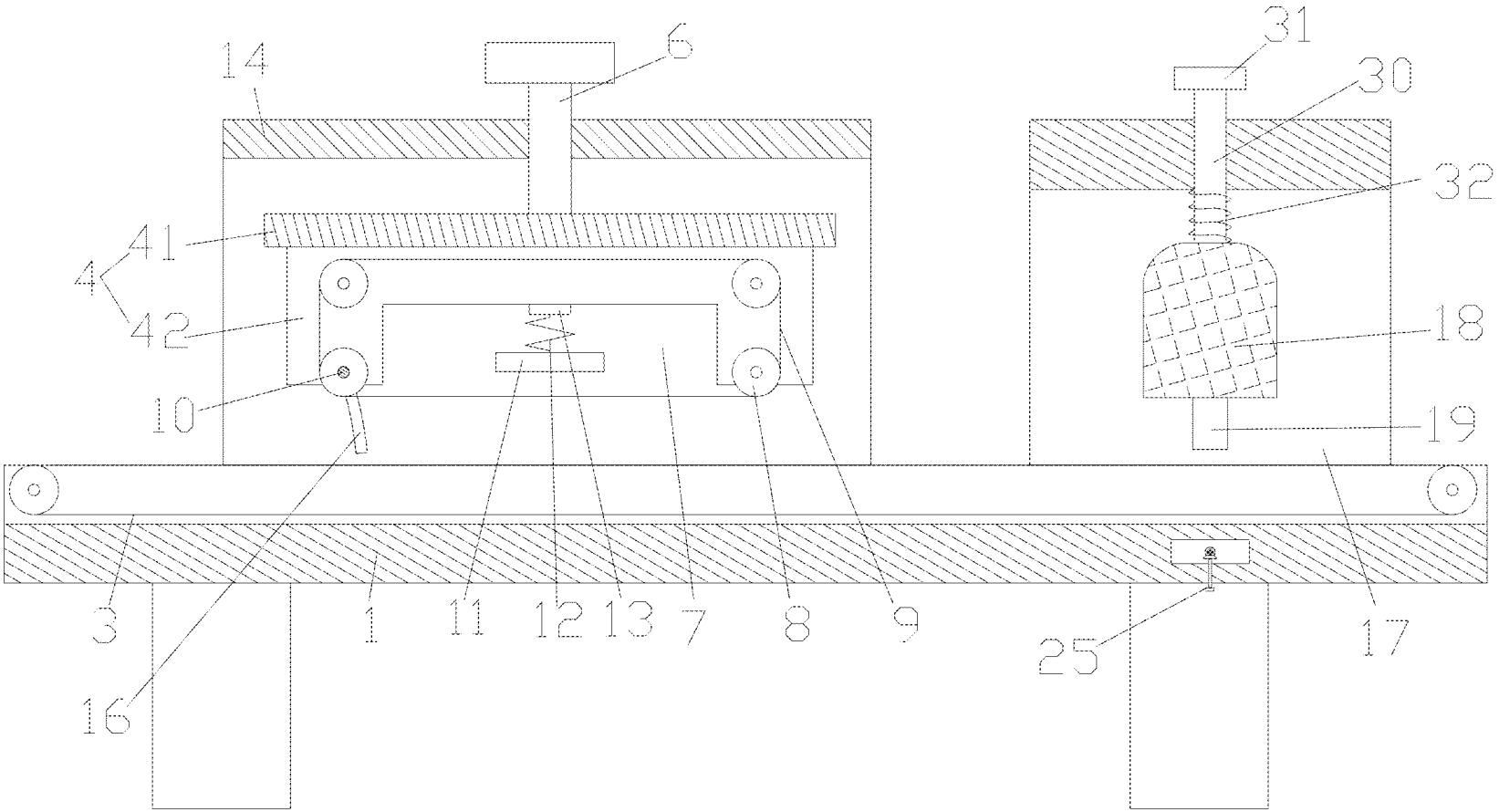
FIG. 2 is a front section view of FIG. 1.

As shown in FIG. 1 and FIG. 2, the embodiment of the present disclosure provides a heat transfer printing code printing system, including a worktable 1. A conveyor belt 3 which is driven by a power device 2 fixedly arranged on the worktable 1 is arranged at the top of the worktable 1 in the length direction thereof. The power device 2 may be a motor. A pressing conveyor and a code printer are sequentially erected on the worktable 1 along a conveying line of the conveyor belt 3. The pressing conveyor includes a mounting frame 14 which is connected to the worktable 1 and is erected on the two sides of the conveying line of the conveyor belt 3. An adjustment frame 4 located above the conveyor belt 3 is arranged on the inner side of the mounting frame 14. Two roller groups that are arranged opposite to each other are rotatably arranged on the inner side of the adjustment frame 4. The two roller groups are distributed above the edges of two sides of the conveying line of the conveyor belt 3. Both acting sides of the two roller groups penetrate out from the bottom of the adjustment frame 4 to the position above the conveyor belt 3. The two roller groups are in coaxial transmission. One of the roller groups is in transmission with a power device 2 through a first belt 5. The adjustment frame 4 is connected to the mounting frame 14 through a guide structure, and the mounting frame 14 is in threaded connection with an adjustment rod 6 that is pressed against the top of the adjustment frame 4. The inner side of the mounting frame 14 is connected to multiple support components that are elastically pressed against the adjustment frame 4. The multiple support components are all located above the acting sides of the two roller groups. When the adjustment frame 4 is moved by rotating the adjustment rod 6, the adjustment frame 4 is moved, through the guide structure, in the direction of an arc which takes the power device 2 as a center and the length of the first belt 5 as a radius.

In the heat transfer printing on-line code printing system, the conveyor belt 3 is driven to operate by the power device 2, and meanwhile, the power device 2 makes one roller group connected thereto operate through the first belt 5. The two roller groups are in coaxial transmission, so that the two roller groups operate synchronously to press and convey the label tape or card tape on the conveyor belt 3. The contact between the two roller groups and the label tape or card tape on the conveyor belt 3 is ensured by matching the position designs of the acting sides of the two roller groups, so as to perform press and convey. In addition, the adjustment frame 4 cannot be in contact with the label tape or card tape on the conveyor belt 3 to limit the conveying. The adjustment frame 4 is supported and fixed by multiple support components. When the distance between the adjustment frame 4 and the conveyor belt 3 needs to be adjusted, the adjustment frame 4 is moved by rotating the adjustment rod 6, and the moving direction of the adjustment frame 4 is limited through the guide structure, so that the first belt 5 is kept in a tension state all the time, thereby driving the conveyor belt 3 and the two roller groups synchronously by the power device 2 all the time. Then, the conveying speeds of the conveyor belt 3 and the two roller groups to the label tape or card tape on the conveyor belt 3 are the same all the time, so that the label tape or card tape on the conveyor belt 3 can be conveyed safely and stably.

Figure 3:
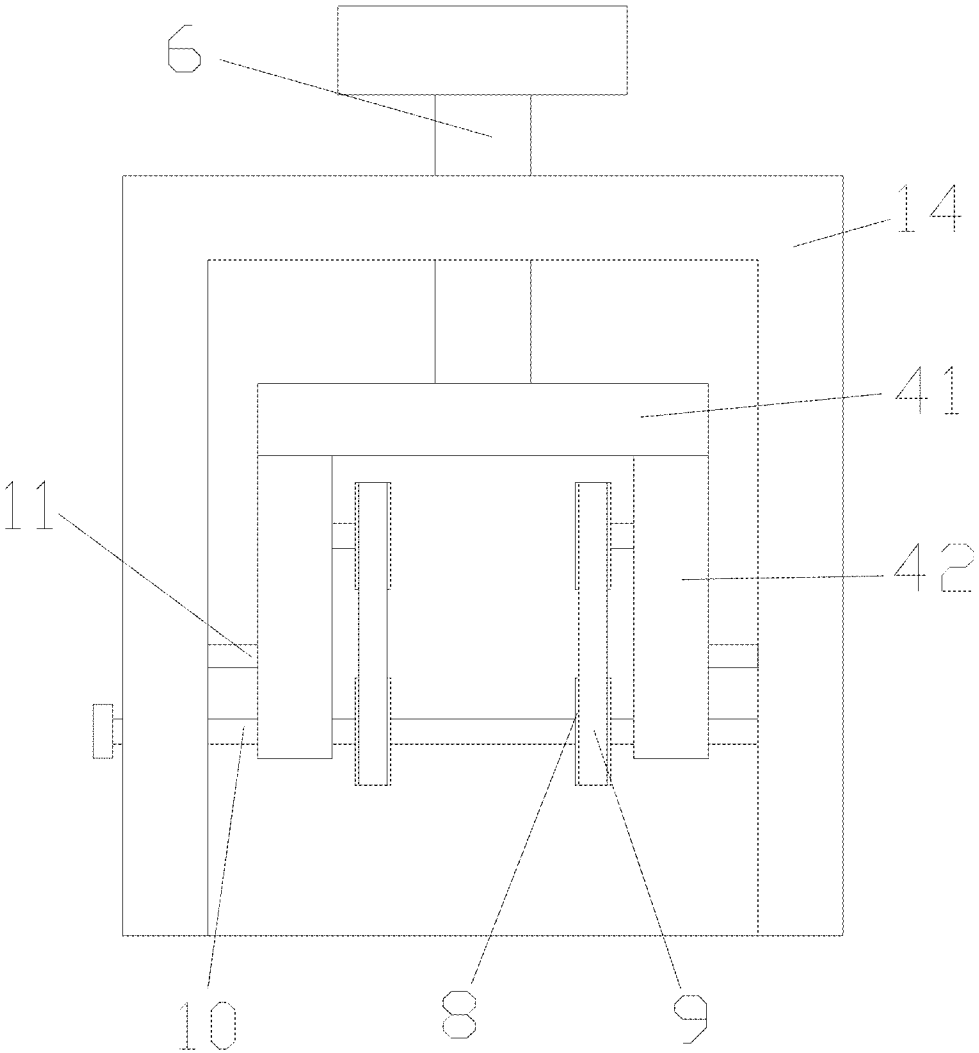
FIG. 3 is a left side view of a pressing conveyor of FIG. 1.

As shown in FIG. 2 and FIG. 3, according to another embodiment of the present disclosure, the heat transfer printing on-line code printing system further includes structure optimization of the adjustment frame 4 and the like. The adopted adjustment frame 4 includes a top plate 41 and vertical plates 42 connected to two sides of the bottom of the top plate 41. The two vertical plates 42 are distributed on the two sides of the conveying line of the conveyor belt 3. The two roller groups are arranged on the surfaces, arranged opposite to each other, of the two vertical plates 42 in one-to-one correspondence. Both acting sides of the two roller groups penetrate below the position between the two vertical plates 42. A gap 7 is formed in the central position of the bottom of each vertical plate 42. A support component is arranged in each gap 7. The support components are elastically pressed against the groove bottoms of the gaps 7 and are located above openings of the gaps 7. The adjustment frame 4 is designed to be formed by the top plate 41 and the two vertical plates 42 for reasonably arranging the two roller groups. The support components are reasonably arranged through the gaps 7 in the vertical plates 42, and meanwhile, the positions between the support components and the gaps 7 are limited, so that the adjustment frame 4 is supported and fixed by the support components, and meanwhile, the bottoms of the support components are prevented from penetrating between each of the acting sides of the two roller groups and the conveyor belt 3 to affect the conveying work of the label tape or card tape when the distance between the two roller groups and the conveyor belt 3 is adjusted.

Each of the adopted roller groups includes four rollers 8 that are rotatably connected to the vertical plate 42. The four rollers 8 are arranged in a rectangular array, and the four rollers 8 are driven by the same second belt 9. The four rollers 8 are all rotatably arranged in the vertical direction, and both bottoms of the lower two rollers 8 are arranged below the position between the two vertical plates 42 in a penetrating manner. One pair of the rollers 8 that are arranged opposite to each other of the two roller groups are coaxially connected through a transmission shaft 10. The transmission shaft 10 is driven to rotate through the first belt 5. The four rollers 8 and one second belt 9 form a roller group. A section of second belt 9 below the four rollers 8 forms a conveying horizontal plane with the same conveying speed as the conveyor belt 3 above it by limiting the mounting positions of the four rollers 8. In addition, the conveying horizontal planes are the acting sides of the two roller groups.

Each of the adopted support components includes a stabilizing plate 11 which is located in the gap 7 and is fixedly connected to the mounting frame 14. The top of the stabilizing plate 11 is connected to a jacking block 13 pressed against the groove bottom of the gap 7 through a jacking spring 12. A bottom support seat of the support component is formed by the stabilizing plate 11. The objective of the design of the support spring is to provide support for the adjustment frame 4, and also provide movement displacement for the movement of the adjustment frame 4. The top plate 13 aims to provide a larger contact area between the support component and the adjustment frame 4, so as to improve the support capacity to the adjustment frame 4.

In combination with FIG. 1 to FIG. 3, according to another embodiment of the present disclosure, the heat transfer printing on-line code printing system further includes structure optimization of the mounting frame 14 and the guide structure. The mounting frame 14 is of an inverted U-shaped structure. The guide structure includes an arc-shaped guide hole 15 formed in the outer wall of a vertical block of the mounting frame 14 and an arc-shaped guide groove 16 formed in the inner wall of the other vertical block of the mounting frame 14 and arranged opposite to the arc-shaped guide hole 15. One end of the transmission shaft 10 is connected to the interior of the arc-shaped guide groove 16 in a sliding and clamping manner, and the other end of the transmission shaft 10 penetrates through the arc-shaped guide hole 15. The arc-shaped guide hole 15 is a circular arc-shaped hole which is formed by taking the power device 2 as a center and the length of the first belt 5 as a radius.

The structural design of the mounting frame 14 is to reasonably mount the structures, such as the adjustment frame 4, and meanwhile, the movement of the transmission shaft 10 is guided through the arc-shaped guide hole 15 formed in the mounting frame 14 and the arc-shaped guide groove 16 matched with the arc-shaped guide hole 15, so as to guide a pair of rollers 8 which are connected through the transmission shaft 10 and are arranged opposite to each other, thereby achieving the purpose of guiding the two roller groups. The arc-shaped guide hole 15 is designed as a circular arc-shaped hole which is formed by taking the power device 2 as a center and the length of the first belt 5 as a radius, which aims to limit the moving direction of the adjustment frame 4 and the two roller groups by matching the arc-shaped guide hole 15 and the arc-shaped guide groove 16 when the distance between the conveyor belt 3 and the adjustment frame 4 is adjusted, so that the first belt 5 is kept in a tension state all the time, and the power device 2 can drive the conveyor belt 3 and the second belt 9 simultaneously all the time. Then, the conveying speeds of the conveyor belt 3 and the second belt 9 to the label tape or card tape on the conveyor belt 3 are the same all the time, so the label tape or card tape on the conveyor belt 3 can be safely and stably fed to the code printer.

The top end of the arc-shaped guide hole 15 is not higher than the bottom of the stabilizing plate 11, which aims to limit the moving positions of the two roller groups and the adjustment frame 4, so that the acting sides of the roller groups are located below the bottoms of the support components all the time, and the roller groups are matched with the conveyor belt 3 to safely and stably feed the label tape or card tape to the code printer.

Figure 4:
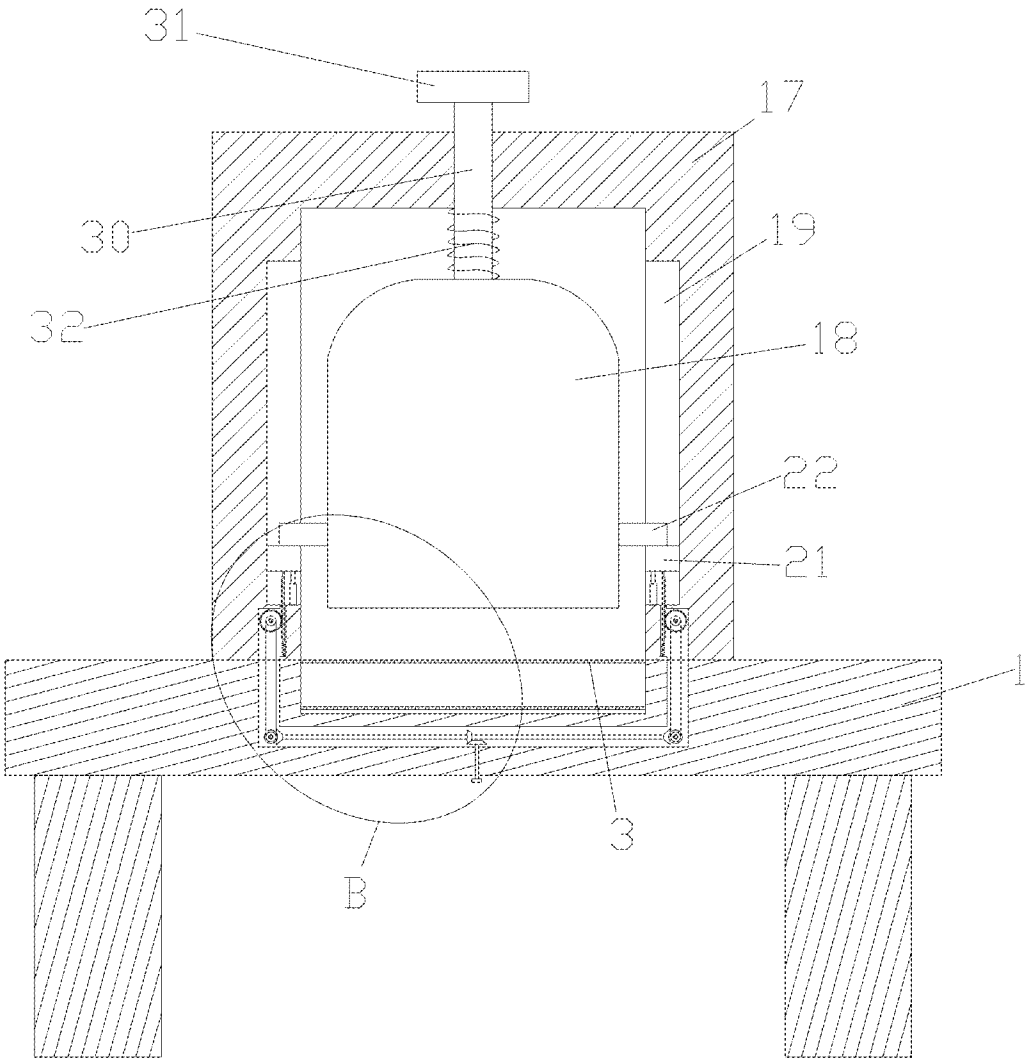
FIG. 4 is a section view along a line A-A of FIG. 1.

As shown in FIG. 4, the embodiment of the present disclosure provides a heat transfer printing on-line code printing system, further including the structure optimization of the code printer. The adopted code printer includes a gantry 17 connected to the top of the worktable 1 and a code printer body 18 arranged in the gantry 17 in the vertical direction in a sliding manner. The gantry 17 is erected on the two sides of the conveying line of the conveyor belt 3. The code printer body 18 is located above the conveyor belt 3. A feeding coding gap is reserved between the code printer body 18 and the conveyor belt 3. An elastic telescopic structure is connected between the top of the code printer body 18 and the gantry 17. An adjustment mechanism for adjusting the height of the feeding coding gap is arranged in the gantry 17 and the worktable 1 in a penetrating manner. Chutes 19 are formed in the two opposite side walls of the gantry 17 in the height direction. A mounting cavity 20 which is communicated with both chutes 19 is formed in the gantry 17. The adjustment mechanism includes a support block 21 arranged in each chute 19 in the length direction thereof in a sliding manner and a height adjustment component arranged in the mounting cavity 20 and connected to both support blocks 21. A power input end of the height adjustment component rotatably penetrates out of the worktable 1 from the mounting cavity 20. Sliding blocks 22 which are fixedly connected to the code printer body 18 are pressed against the tops of the two support blocks 21. The sliding blocks 22 are arranged inside and outside of the corresponding chutes 19 in a penetrating manner. The support blocks 21 are moved in the length directions of the chutes 19 in the corresponding chutes 19 through the height adjustment component by rotating the power input end of the height adjustment component.

The code printer body 18 is connected to the gantry 7 through an elastic telescopic structure. The adoption of the elastic telescopic structure facilitates adjusting the height of the code printer body 18. The support blocks 21 are moved in the corresponding chutes 19 in the length directions of the chutes 19 through the height adjustment component by rotating the power input end of the height adjustment component. In the moving process of the two support blocks 21 in the corresponding chutes 19, the two sliding blocks 22 drive the code printer body to move in the gantry 17 in the height direction because of the connecting state of the sliding blocks 22 and the support blocks 21, so as to achieve the purpose of adjusting the height of the feeding coding gap, thereby meeting the work of printing codes and marking the label tapes or card tapes with different thicknesses. The height of the feeding coding gap is increased or decreased by different rotating directions of the power input end of the height adjustment component.

Figure 5:
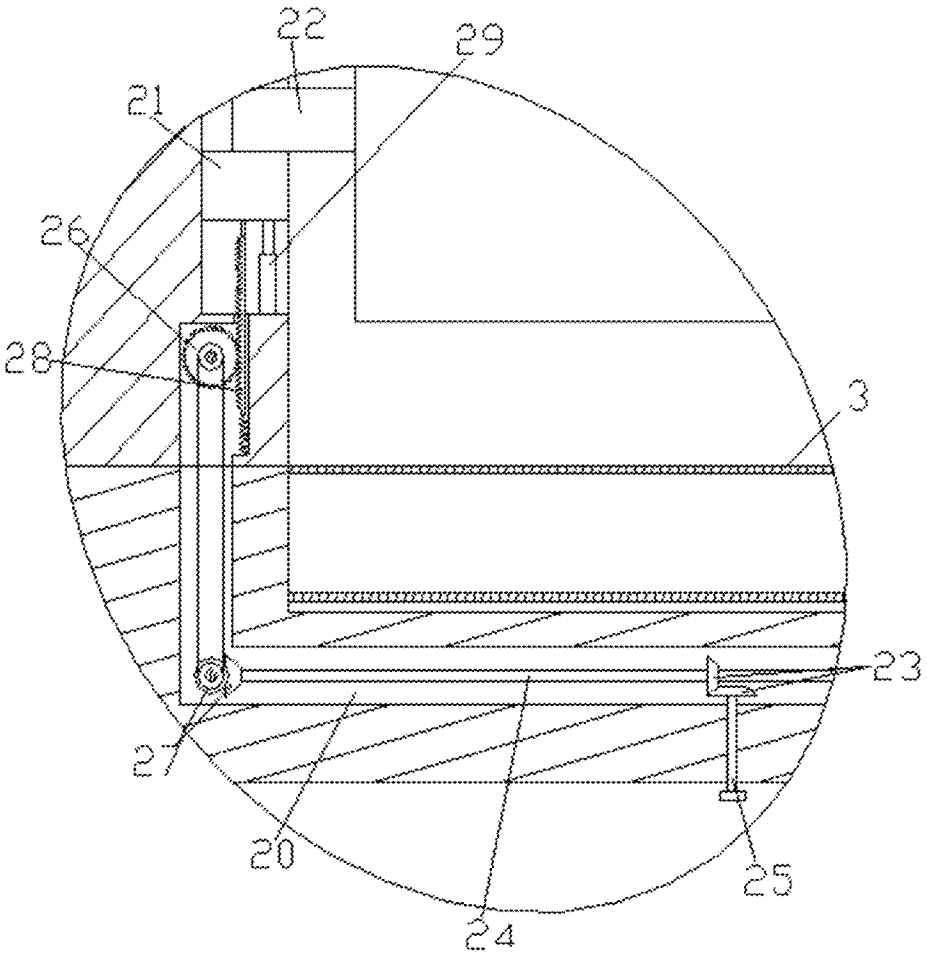
FIG. 5 is an enlarged view of part B in FIG. 4.

As shown in FIG. 5, according to another embodiment of the present disclosure, the heat transfer printing on-line code printing system further includes structure optimization of the height adjustment component. The adopted height adjustment component includes a driving part rotatably arranged in the mounting cavity 20 and transmission parts connected between the driving part and each of the two support blocks 21. The two transmission parts are of the same structure and are symmetrically arranged about the driving part. The two transmission parts are arranged between the mounting cavity 20 and the corresponding chutes 19 in a penetrating manner. A power input end of the driving part rotatably penetrates out of the worktable 1 from the mounting cavity 20. The design of the position of the power input end of the driving part is to facilitate adjusting it. The power input end of the driving part makes the two support blocks 21 move synchronously through the two transmission parts after inputting power, so as to stably adjust the height of the code printer body 18, thereby changing the height of the feeding coding gap.

Specifically, the adopted driving part includes two first bevel gears 23 rotatably arranged in the mounting cavity 20. The two first bevel gears 23 are arranged in an engaged manner, where one of the bevel gears is connected to the two transmission parts through a transmission rod 24 arranged in the mounting cavity 20, and the other of the bevel gears is connected to a driving rod 25 which rotatably penetrates out of the worktable 1 from the mounting cavity 20.

Each of the adopted transmission parts includes a circular gear 26 and two second bevel gears 27 rotatably arranged in the mounting cavity 20. The two second bevel gears 27 are arranged in an engaged manner. One of the second bevel gears 27 is connected to the transmission rod 24, and the other of the second bevel gears 27 is in transmission with the circular gear 26 through a belt transmission structure. A gear rack 28 which penetrates between the mounting cavity 20 and the chute 19 in a sliding manner is arranged on the circular gear 26 in an engaged manner. One end of the gear rack 28 is connected to the support block 21; a support spring is connected between the other end of the gear rack 28 and the inner wall of the mounting cavity 20, where the transmission structure is a matching structure of the existing belt and pulley.

The two first bevel gears 23 are rotated by working personnel by rotating the driving rod 25, so that the transmission rod 24 drives the two second bevel gears 27 of the two transmission parts to rotate, the second bevel gears 27 makes the circular gear 26 rotate through the transmission structure, and the rotating circular gear 26 drives the gear rack 28 to move, thereby moving the support blocks 21 in the chutes 19. The two transmission parts are of the same structures and are arranged symmetrically about the driving part, so as to make the two support blocks 21 move synchronously. The two sliding blocks 22 drive the code printer body to move in the gantry 17 in the height direction through the connecting state of the sliding blocks 22 and the support blocks 21, so as to achieve the purpose of adjusting the height of the feeding coding gap. The support spring achieves the purposes of supporting, moving, and resetting on the gear rack 28.

As shown in FIG. 5, according to another embodiment of the present disclosure, the heat transfer printing on-line code printing system further includes an elastic telescopic rod 29 connected between one side wall, connected to the gear rack 28, of each support block 21 and the inner wall of the chute 19 matched with the support block 21. The telescoping direction of the elastic telescopic rod 29 is the same as the moving direction of the gear rack 28. The support blocks 21 are further supported through the elastic telescopic rods 29, so as to improve the stability of the support blocks 21 after the positions are adjusted, thereby achieving the purpose of improving the stability of the code printer body 18 when code printing and marking are performed. The telescopic arrangement manner of the elastic telescopic rod 29 is to perform telescopic adjustment along the movement of the gear rack 28 without hindering the movement of the gear rack 28.

As shown in FIG. 4, according to another embodiment of the present disclosure, the heat transfer printing on-line code printing system further includes structure optimization of the elastic telescopic structure. The adopted elastic telescopic structure includes a traction rod 30 connected to the top of the code printer body 18. One end of the traction rod 30 is connected with a limiting block 31 located above the gantry 17 after freely penetrating through a cross beam of the gantry 17. A support sleeve spring 32 which is connected between the top of the code printer body 18 and the cross beam of the gantry 17 is arranged on the traction rod 30 in a sleeving manner. The traction rod 30 draws the moving direction of the code printer body 18. The limiting block 31 is designed to limit the movement of the code printer body 18, so as to prevent the code printer body 18 from pressing against the worktable 1, and also prevent the traction rod 30 from disconnecting from the cross beam of the gantry 17. A support sleeve spring 32 further tensions and fixes the code printer body 18.

Through the coordination of the conveyor belt 3 and the second belt 9, the label tape or card tape can be safely and stably conveyed to an acting end at the bottom of the code printer body 18 to perform continuous work of printing codes and marking, and then, the label tape or card tape which is subjected to code printing and marking is conveyed away through the conveyor belt 3. Stable feeding is performed on the code printer body 18 through the coordination of the two roller groups and the conveyor belt 3.

Finally, it is explained that the above embodiments are only used to illustrate rather than limit the technical solutions of the present disclosure. Although the present disclosure has been described in detail with reference to preferred embodiments, those of ordinary skill in the art should understand that modifications or equivalent replacements may be made to the technical solutions of the present disclosure, which shall be covered within the scope of the claims of the present disclosure without deviating from the purpose and scope of the technical solutions of the present disclosure.

What is claimed is:

1. A heat transfer printing on-line code printing system, comprising a worktable, wherein a conveyor belt which is driven by a power device fixedly arranged on the worktable is arranged at the top of the worktable in the length direction thereof; a pressing conveyor and a code printer are sequentially erected on the worktable along a conveying line of the conveyor belt; the pressing conveyor includes a mounting frame which is connected to the worktable and is erected on the two sides of the conveying line of the conveyor belt; an adjustment frame located above the conveyor belt is arranged on the inner side of the mounting frame; two roller groups that are arranged opposite to each other are rotatably arranged on the inner side of the adjustment frame; the two roller groups are distributed above the edges of two sides of the conveying line of the conveyor belt; both acting sides of the two roller groups penetrate out from the bottom of the adjustment frame to the position above the conveyor belt; the two roller groups are in coaxial transmission; one of the roller groups is in transmission with a power device through a first belt;

the adjustment frame is connected to the mounting frame through a guide structure, and the mounting frame is in threaded connection with an adjustment rod that is pressed against the top of the adjustment frame; the inner side of the mounting frame is connected to multiple support components that are elastically pressed against the bottom of the adjustment frame; the multiple support components are all located above the acting sides of the two roller groups;

when the adjustment frame is moved by rotating the adjustment rod, the adjustment frame is moved, through the guide structure, in the direction of an arc which takes the power device as a center and the length of the first belt as a radius.

2. The heat transfer printing on-line code printing system according to claim 1, wherein the adjustment frame comprises a top plate and vertical plates connected to the two sides of the bottom of the top plate; the two vertical plates are distributed on the two sides of the conveying line of the conveyor belt; the two roller groups are arranged on the surfaces, arranged opposite to each other, of the two vertical plates in one-to-one correspondence; both acting sides of the two roller groups penetrate below the position between the two vertical plates; a gap is formed in the central position of the bottom of each vertical plate; a support component is arranged in each gap; the support components are elastically pressed against the groove bottoms of the gaps and are located above the openings of the gaps.

3. The heat transfer printing on-line code printing system according to claim 2, wherein each roller group comprises four rollers that are rotatably connected to the vertical plate; the four rollers are arranged in a rectangular array, and the four rollers are driven by the same second belt; the four rollers are all rotatably arranged in the vertical direction, and both bottoms of the lower two rollers are arranged below the position between the two vertical plates in a penetrating manner; one pair of the rollers that are arranged opposite to each other of the two roller groups are coaxially connected through a transmission shaft; the transmission shaft is driven to rotate through the first belt.

4. The heat transfer printing on-line code printing system according to claim 3, wherein each support component comprises a stabilizing plate located in the gap and fixedly connected to the mounting frame; the top of the stabilizing plate is connected to a jacking block pressed against the groove bottom of the gap through a jacking spring.

5. The heat transfer printing on-line code printing system according to claim 4, wherein the mounting frame is of an inverted U-shaped structure; the guide structure comprises an arc-shaped guide hole formed in the outer wall of a vertical block of the mounting frame and an arc-shaped guide groove formed in the inner wall of the other vertical block of the mounting frame and arranged opposite to the arc-shaped guide hole; one end of the transmission shaft is connected to the interior of the arc-shaped guide groove in a sliding and clamping manner, and the other end of the transmission shaft penetrates through the arc-shaped guide hole; the arc-shaped guide hole is a circular arc-shaped hole which is formed by taking the power device as a center and the length of the first belt as a radius; the top end of the arc-shaped guide hole is not higher than the bottom of the stabilizing plate.

6. The heat transfer printing on-line code printing system according to claim 5, wherein the code printer comprises a gantry connected to the top of the worktable and a code printer body arranged in the gantry in the vertical direction in a sliding manner; the gantry is erected on the two sides of the conveying line of the conveyor belt; the code printer body is located above the conveyor belt; a feeding coding gap is reserved between the code printer body and the conveyor belt; an elastic telescopic structure is connected between the top of the code printer body and the gantry; an adjustment mechanism for adjusting the height of the feeding coding gap is arranged in the gantry and the worktable in a penetrating manner; chutes are formed in the two opposite side walls of the gantry in the height direction; a mounting cavity which is communicated with both chutes is formed in the gantry; the adjustment mechanism comprises a support block arranged in each chute in the length direction thereof in a sliding manner and a height adjustment component arranged in the mounting cavity and connected to both support blocks; a power input end of the height adjustment component rotatably penetrates out of the worktable from the mounting cavity; sliding blocks which are fixedly connected to the code printer body are pressed against the tops of the two support blocks; the sliding blocks are arranged inside and outside of the corresponding chutes in a penetrating manner; the support blocks move in the corresponding chutes in the length directions of the chutes through the height adjustment component by rotating the power input end of the height adjustment component.

7. The heat transfer printing on-line code printing system according to claim 6, wherein the height adjustment component comprises a driving part rotatably arranged in the mounting cavity and transmission parts connected between the driving part and each of the two support blocks; the two transmission parts are of the same structure and are symmetrically arranged about the driving part; the two transmission parts are arranged between the mounting cavity and the corresponding chutes in a penetrating manner; the power input end of the driving part rotatably penetrates out of the worktable from the mounting cavity.

8. The heat transfer printing on-line code printing system according to claim 4, wherein the code printer comprises a gantry connected to the top of the worktable and a code printer body arranged in the gantry in the vertical direction in a sliding manner; the gantry is erected on the two sides of the conveying line of the conveyor belt; the code printer body is located above the conveyor belt; a feeding coding gap is reserved between the code printer body and the conveyor belt; an elastic telescopic structure is connected between the top of the code printer body and the gantry; an adjustment mechanism for adjusting the height of the feeding coding gap is arranged in the gantry and the worktable in a penetrating manner; chutes are formed in the two opposite side walls of the gantry in the height direction; a mounting cavity which is communicated with both chutes is formed in the gantry; the adjustment mechanism comprises a support block arranged in each chute in the length direction thereof in a sliding manner and a height adjustment component arranged in the mounting cavity and connected to both support blocks; a power input end of the height adjustment component rotatably penetrates out of the worktable from the mounting cavity; sliding blocks which are fixedly connected to the code printer body are pressed against the tops of the two support blocks; the sliding blocks are arranged inside and outside of the corresponding chutes in a penetrating manner; the support blocks move in the corresponding chutes in the length directions of the chutes through the height adjustment component by rotating the power input end of the height adjustment component.

9. The heat transfer printing on-line code printing system according to claim 8, wherein the height adjustment component comprises a driving part rotatably arranged in the mounting cavity and transmission parts connected between the driving part and each of the two support blocks; the two transmission parts are of the same structure and are symmetrically arranged about the driving part; the two transmission parts are arranged between the mounting cavity and the corresponding chutes in a penetrating manner; the power input end of the driving part rotatably penetrates out of the worktable from the mounting cavity.

10. The heat transfer printing on-line code printing system according to claim 3, wherein the code printer comprises a gantry connected to the top of the worktable and a code printer body arranged in the gantry in the vertical direction in a sliding manner; the gantry is erected on the two sides of the conveying line of the conveyor belt; the code printer body is located above the conveyor belt; a feeding coding gap is reserved between the code printer body and the conveyor belt; an elastic telescopic structure is connected between the top of the code printer body and the gantry; an adjustment mechanism for adjusting the height of the feeding coding gap is arranged in the gantry and the worktable in a penetrating manner; chutes are formed in the two opposite side walls of the gantry in the height direction; a mounting cavity which is communicated with both chutes is formed in the gantry; the adjustment mechanism comprises a support block arranged in each chute in the length direction thereof in a sliding manner and a height adjustment component arranged in the mounting cavity and connected to both support blocks; a power input end of the height adjustment component rotatably penetrates out of the worktable from the mounting cavity; sliding blocks which are fixedly connected to the code printer body are pressed against the tops of the two support blocks; the sliding blocks are arranged inside and outside of the corresponding chutes in a penetrating manner; the support blocks move in the corresponding chutes in the length directions of the chutes through the height adjustment component by rotating the power input end of the height adjustment component.

11. The heat transfer printing on-line code printing system according to claim 10, wherein the height adjustment component comprises a driving part rotatably arranged in the mounting cavity and transmission parts connected between the driving part and each of the two support blocks; the two transmission parts are of the same structure and are symmetrically arranged about the driving part; the two transmission parts are arranged between the mounting cavity and the corresponding chutes in a penetrating manner; the power input end of the driving part rotatably penetrates out of the worktable from the mounting cavity.

12. The heat transfer printing on-line code printing system according to claim 11, wherein the driving part comprises two first bevel gears rotatably arranged in the mounting cavity; the two bevel gears are arranged in an engaged manner, wherein one of the bevel gears is connected to the two transmission parts through a transmission rod arranged in the mounting cavity; the other of the bevel gears is connected to a driving rod which rotatably penetrates out of the worktable from the mounting cavity.

13. The heat transfer printing on-line code printing system according to claim 2, wherein the code printer comprises a gantry connected to the top of the worktable and a code printer body arranged in the gantry in the vertical direction in a sliding manner; the gantry is erected on the two sides of the conveying line of the conveyor belt; the code printer body is located above the conveyor belt; a feeding coding gap is reserved between the code printer body and the conveyor belt; an elastic telescopic structure is connected between the top of the code printer body and the gantry; an adjustment mechanism for adjusting the height of the feeding coding gap is arranged in the gantry and the worktable in a penetrating manner; chutes are formed in the two opposite side walls of the gantry in the height direction; a mounting cavity which is communicated with both chutes is formed in the gantry; the adjustment mechanism comprises a support block arranged in each chute in the length direction thereof in a sliding manner and a height adjustment component arranged in the mounting cavity and connected to both support blocks; a power input end of the height adjustment component rotatably penetrates out of the worktable from the mounting cavity; sliding blocks which are fixedly connected to the code printer body are pressed against the tops of the two support blocks; the sliding blocks are arranged inside and outside of the corresponding chutes in a penetrating manner; the support blocks move in the corresponding chutes in the length directions of the chutes through the height adjustment component by rotating the power input end of the height adjustment component.

14. The heat transfer printing on-line code printing system according to claim 13, wherein the height adjustment component comprises a driving part rotatably arranged in the mounting cavity and transmission parts connected between the driving part and each of the two support blocks; the two transmission parts are of the same structure and are symmetrically arranged about the driving part; the two transmission parts are arranged between the mounting cavity and the corresponding chutes in a penetrating manner; the power input end of the driving part rotatably penetrates out of the worktable from the mounting cavity.

15. The heat transfer printing on-line code printing system according to claim 14, wherein the driving part comprises two first bevel gears rotatably arranged in the mounting cavity; the two bevel gears are arranged in an engaged manner, wherein one of the bevel gears is connected to the two transmission parts through a transmission rod arranged in the mounting cavity; the other of the bevel gears is connected to a driving rod which rotatably penetrates out of the worktable from the mounting cavity.

16. The heat transfer printing on-line code printing system according to claim 1, wherein the code printer comprises a gantry connected to the top of the worktable and a code printer body arranged in the gantry in the vertical direction in a sliding manner; the gantry is erected on the two sides of the conveying line of the conveyor belt; the code printer body is located above the conveyor belt; a feeding coding gap is reserved between the code printer body and the conveyor belt; an elastic telescopic structure is connected between the top of the code printer body and the gantry; an adjustment mechanism for adjusting the height of the feeding coding gap is arranged in the gantry and the worktable in a penetrating manner; chutes are formed in the two opposite side walls of the gantry in the height direction; a mounting cavity which is communicated with both chutes is formed in the gantry; the adjustment mechanism comprises a support block arranged in each chute in the length direction thereof in a sliding manner and a height adjustment component arranged in the mounting cavity and connected to both support blocks; a power input end of the height adjustment component rotatably penetrates out of the worktable from the mounting cavity; sliding blocks which are fixedly connected to the code printer body are pressed against the tops of the two support blocks; the sliding blocks are arranged inside and outside of the corresponding chutes in a penetrating manner; the support blocks move in the corresponding chutes in the length directions of the chutes through the height adjustment component by rotating the power input end of the height adjustment component.

17. The heat transfer printing on-line code printing system according to claim 16, wherein the height adjustment component comprises a driving part rotatably arranged in the mounting cavity and transmission parts connected between the driving part and each of the two support blocks; the two transmission parts are of the same structure and are symmetrically arranged about the driving part; the two transmission parts are arranged between the mounting cavity and the corresponding chutes in a penetrating manner; the power input end of the driving part rotatably penetrates out of the worktable from the mounting cavity.

18. The heat transfer printing on-line code printing system according to claim 17, wherein the driving part comprises two first bevel gears rotatably arranged in the mounting cavity; the two bevel gears are arranged in an engaged manner, wherein one of the bevel gears is connected to the two transmission parts through a transmission rod arranged in the mounting cavity; the other of the bevel gears is connected to a driving rod which rotatably penetrates out of the worktable from the mounting cavity.

19. The heat transfer printing on-line code printing system according to claim 18, wherein each transmission part comprises a circular gear and two second bevel gears rotatably arranged in the mounting cavity; the two second bevel gears are arranged in an engaged manner; one of the second bevel gears is connected to the transmission rod; the other of the second bevel gears is in transmission with the circular gear through a belt transmission structure; a gear rack which penetrates between the mounting cavity and the chute in a sliding manner is arranged on the circular gear in an engaged manner; one end of the gear rack is connected to the support block; a support spring is connected between the other end of the gear rack and the inner wall of the mounting cavity.

20. The heat transfer printing on-line code printing system according to claim 16, wherein the elastic telescopic structure comprises a traction rod connected to the top of the code printer body; one end of the traction rod is connected with a limiting block located above the gantry after freely penetrating through a cross beam of the gantry; a support sleeve spring which is connected between the top of the code printer body and the cross beam of the gantry is arranged on the traction rod in a sleeving manner.

* * * * *